US005702167A

United States Patent [19]

Müller

[11] Patent Number: 5,702,167

[45] Date of Patent: Dec. 30, 1997

[54] DRAWER LOCKING MEANS FOR DRAWERS ARRANGED ONE ABOVE THE OTHER

[75] Inventor: Hans Friedrich Müller, Ruppichteroth, Germany

[73] Assignee: Huwil-Werke GmbH, Ruppichteroth, Germany

[21] Appl. No.: 512,383

[22] Filed: Aug. 8, 1995

[30] Foreign Application Priority Data

Dec. 20, 1994 [DE] Germany ..... 94 20 359 U

[51] Int. Cl.[6] ..... E05B 65/46

[52] U.S. Cl. ..... 312/221; 312/217

[58] Field of Search ..... 312/219, 216, 312/217, 221, 215, 222

[56] References Cited

U.S. PATENT DOCUMENTS

| | | | |
|---|---|---|---|
| 3,900,236 | 8/1975 | Goulish et al. . | |
| 3,909,090 | 9/1975 | Breckner et al. | 312/217 |
| 4,003,614 | 1/1977 | Geer et al. . | |
| 4,240,685 | 12/1980 | Terlecki | 312/217 |
| 4,768,844 | 9/1988 | Ludwig . | |
| 4,889,396 | 12/1989 | Mitchell et al. | 312/217 X |
| 4,936,640 | 6/1990 | Pratzer | 312/221 |

FOREIGN PATENT DOCUMENTS

| | | |
|---|---|---|
| 0290241A1 | 11/1988 | European Pat. Off. . |
| 2131548 | 10/1972 | Germany . |
| 4115125A1 | 12/1991 | Germany . |
| 4315452A1 | 1/1994 | Germany . |
| 93115342 U | 1/1994 | Germany . |
| 1175151 | 12/1969 | United Kingdom . |

*Primary Examiner*—Peter M. Cuomo
*Assistant Examiner*—Janet M. Wilkens
*Attorney, Agent, or Firm*—Harness, Dickey & Pierce, P.L.C.

[57] ABSTRACT

A drawer locking mechanism for at least two drawers (6, 6') arranged one above the other has locking slides (13, 13') whose height is adjustable in a guide (7) along a setting axis (12). Setting elements (22, 22') with setting slots (29, 29') are attached with the slides between front panel (9, 9') of the drawer and the guide (7) arranged on the inner face of the side wall (2) of the body (1). Furthermore, the setting elements (22, 22') have two engagement regions which secure the setting elements (22, 22') in their respective angular positions corresponding to a pushed-in or pulled-out position of the drawers (6, 6'). Accordingly, control pins (31, 31'), associated with the side walls of the drawers (6, 6') as viewed from the front panels (9, 9') of the drawers (6, 6'), are positioned in front of the guide (7). Thus, the control pins do not have to pass the guide when the drawers are opened or closed, thereby improving utilization of space. Also, while the installation width of the body remains the same, it is possible to select a connecting guide.

10 Claims, 4 Drawing Sheets

DRAWER LOCKING MEANS FOR DRAWERS ARRANGED ONE ABOVE THE OTHER

BACKGROUND OF THE INVENTION

The invention relates to a drawer locking mechanism for at least two drawers arranged one above the other in a body of a piece of furniture. The drawers include a front panel, two side walls, a rear wall, and optionally, the drawers include a base. Locking slides are positioned at one side wall of the body transverse to the sliding planes of the drawers. Also, the locking slides are linearly adjustable along a setting axis in a guide. Further, the drawer includes setting elements associated with the locking slides. The setting elements are fixed to the associated locking slide so as to be pivotable to a limited extent between an open position and a locking position around a pivot axis extending perpendicularly to the setting axis. The setting elements also include a setting contour in contact with setting stops of the adjoining locking slide or of a supporting element. Further each drawer includes a control mechanism arranged at the side walls of the drawers positioned opposite the side wall of the body. The locking slides, when operating the drawer, are loadable for the purpose of adjusting a setting element. Also, the drawers include stops which limit the adjustment path of the locking slide and, optionally, of the supporting element.

Locking mechanisms for drawers arranged one above the other are described in U.S. Pat. No. 3,900,236. Here, the drawers provide a plurality of locking slides in the form of bars which are adjustably held in a guide of the body. A locking slide associated with each drawer, at its lower end, includes a pivot disc which constitutes the setting element. The setting element is pivotable to a limited extent and has a setting contour which is supported on a bent clip of the upper end of the locking slide of the drawer positioned thereunder. Furthermore, each pivot disc has a projection which cooperates with a control element with ramp faces attached at the upper end of a side wall of the associated drawer. If viewed from the front panels of the drawers, the ramp faces are provided towards the rear, behind the pivot disc when the drawer is in the pushed-in position. The guide of the locking slides are attached so as to be displaced towards the inside of the body. When opening a drawer, the ramp faces, when passing the pivot disc, act thereon and adjust same in the sense of pivoting it when a friction contact is generated between the outer face of the projection and the ramp faces of the control element. In the process, the associated locking slide is displaced downwardly. Together therewith, the locking slides of all drawers positioned thereabove are simultaneously displaced upwardly and adjusted against the inner face of the cover plate of the body. The pivot disc of the setting element of the lowermost drawer is supported against a supporting element which, in turn, is supported against the inner face of the base of the body. Thus, when a drawer is moved in an opening sense and when its associated pivot disc effects an upward adjustment of the locking slides, it is ensured that the remaining drawers can no longer be pulled out. A further displacement of the locking slides is prevented through stopping against the inner face of the ceiling and by support against the inner face of the base of the body.

After the opened drawer has been pushed back, the associated pivot disc is pivoted back into its starting position as a result of friction contact between its projection and the ramp faces of the control element. The associated locking slide and all locking slides positioned thereabove, after passing the ramp face in the guide, adjust themselves downwardly into the starting position due to their dead weight. The drawers are individually lockable by locks.

One disadvantage of the above is that there has to be a large free lateral space between the side walls of the drawer, with which the control element is associated, and the side wall of the body. The space is necessary since, when pulling out and pushing in the drawer, the drawer has to pass the guide and the setting element. A further disadvantage exists in that the drawers, to be secured in the pushed-in position, need to be individually locked because each drawer is associated with its own lock. As the setting elements, in the form of pivot discs, are held in their respective positions only by friction locking, a return movement may take place automatically in the case of vibrations. This means that the drawers, which have not been pulled out, are not secured against being pulled out because the locking slides, due to their dead weight, return into their starting positions.

SUMMARY OF THE INVENTION

It is the object of the invention to provide a drawer locking mechanism which permits safe function under all circumstances.

In accordance with the invention, all locking slides are jointly loaded by a spring to contact with one of the stops. The setting elements each include a setting slot extending parallel to the setting axis in the pushed-in condition of the drawers. The drawers each carry a control pin. The control pins, in the pushed-in condition of the drawers, engage the setting slots of the setting elements. The control contours include a first engagement region for holding the setting elements in a position corresponding to the pushed-in condition of the drawers and a second engagement region to hold the setting element of the operated drawer in a pivoted locking position which corresponds to the open position of the operated drawer. The locking slides of the drawers adjoin the locking slide of the operated drawer in the direction of the spring displaced against a stop.

A further advantage is that the control elements, if viewed in the sense of pulling out the drawer, can be arranged in front of the guide so that they do not have to pass same when a drawer is pulled out or pushed in. In consequence, while the space of the body is utilized in the same way, it is possible for the locking slides guide to be arranged in a contacting way or, in the case of an inserted arrangement, better use is made of the available space. Thus, it is possible to use drawers with a greater width.

Another advantage is the setting elements are held more securely in their respective positions by the provided regions of engagement.

By using a setting slot combined with a control pin form-fittingly engaging the slot, it is possible to achieve a compulsory adjustment. Thus, it is ensured that during the service life of the parts, actuating conditions do not change, which is the case with the state of the art due to the changing friction conditions. In the state of the art, for increasing the friction value, a rubber ring is provided which is subject to wear.

Furthermore, the regions of engagement ensure defined end positions which cannot be adversely affected by vibrations.

A further advantage is the length of the control pin may be such that it extends into the vicinity of the side wall of the body. Thus, it is able, fully, to pass the setting slot, so that in spite of any lateral play of the drawer, the control pin remains in the setting slot.

According to a further embodiment of the invention, the setting stops are each arranged at the lower end of the locking slide or of the supporting element. The setting elements are each arranged at the upper end of the locking slide.

The setting stops are preferably rollers. The rollers may be made of plastics and the setting elements may also be made of plastics to substantially eliminate noise generated during the adjusting process.

According to a further embodiment of the invention, the locking slides are loaded by the spring in the upward direction against the first stop arranged above the locking slide. The advantage of this embodiment is that, in view of the arrangement of the spring, the locking slides assume a defined position which is independent of the guiding quality and the friction conditions when a displacement takes place.

A further substantial characteristic is the first stop is adjustable along the setting axis against the spring. This permits a central locking system by adjusting the first stop by a lock, all drawers can be locked. By displacing all locking slides against the second stop, the setting elements are prevented from pivoting, even if a pulling effect is exerted on one of the drawers. The shape of the setting contour achieved by providing the regions of engagement leads to a kind of form-fitting effect because the locking slides and the supporting element cannot escape either upwardly or downwardly. They are immovably held between the stops along the setting axis. As the setting elements, when transferred into the central closing position, are displaced downwardly, the control pins, too, enter the setting slots more deeply so that the vertical distance is reduced between the pivot axis of the setting elements and the control pins. This results in a reduction in the effective lever arm which, when the drawers are subjected to a pulling effect, wants to pivot the setting elements.

Alternatively, the first stop may also be formed by the supporting element. The second stop may be formed either by the spring adjusted to form a block and supported against a fixed bearing or by a face of the fixed bearing itself. In order to increase the embrace of the setting stops, which are preferably provided in the form of rollers, a supporting lug is associated with the first region of engagement. A central locking position may also be achieved. Here the guide itself is adjustable, in which case the first stop is firmly secured to the side wall of the body, for instance by a clip.

Preferably, a lock is provided to centrally lock or release all drawers.

From the following detailed description taken in conjunction with the accompanying drawings and subjoined claims, other objects and advantages of the present invention will become apparent to those skilled in the art.

BRIEF DESCRIPTION OF THE DRAWINGS

A preferred embodiment of the invention is diagrammatically illustrated in the drawing wherein.

DETAILED DESCRIPTION OF THE DRAWINGS

Figure 1:
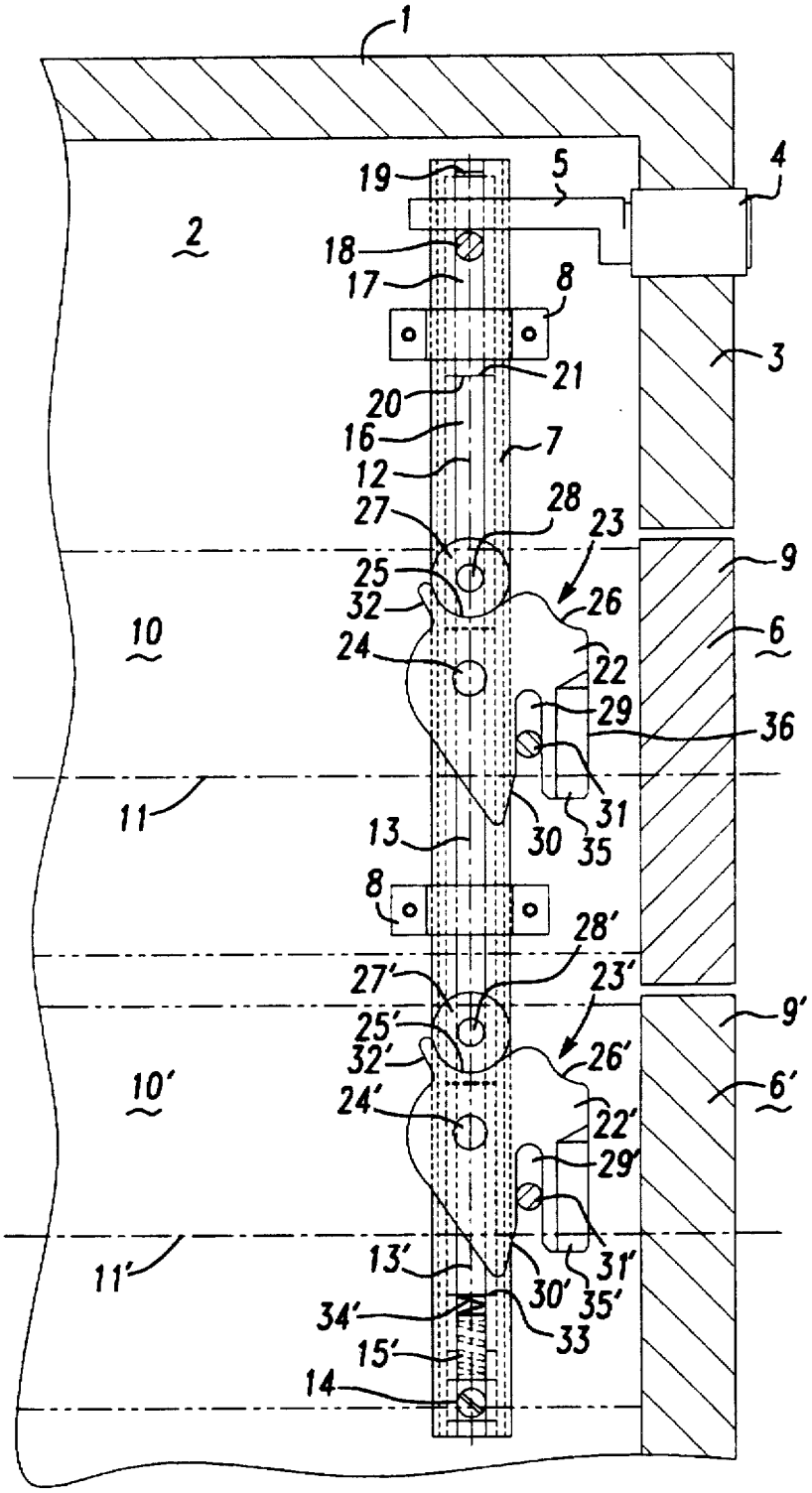
FIG. 1 is an elevation partially in section view of a body containing the drawers in the pushed-in position to permit a view of the arrangement of the setting elements and locking slides.
Figure 2:
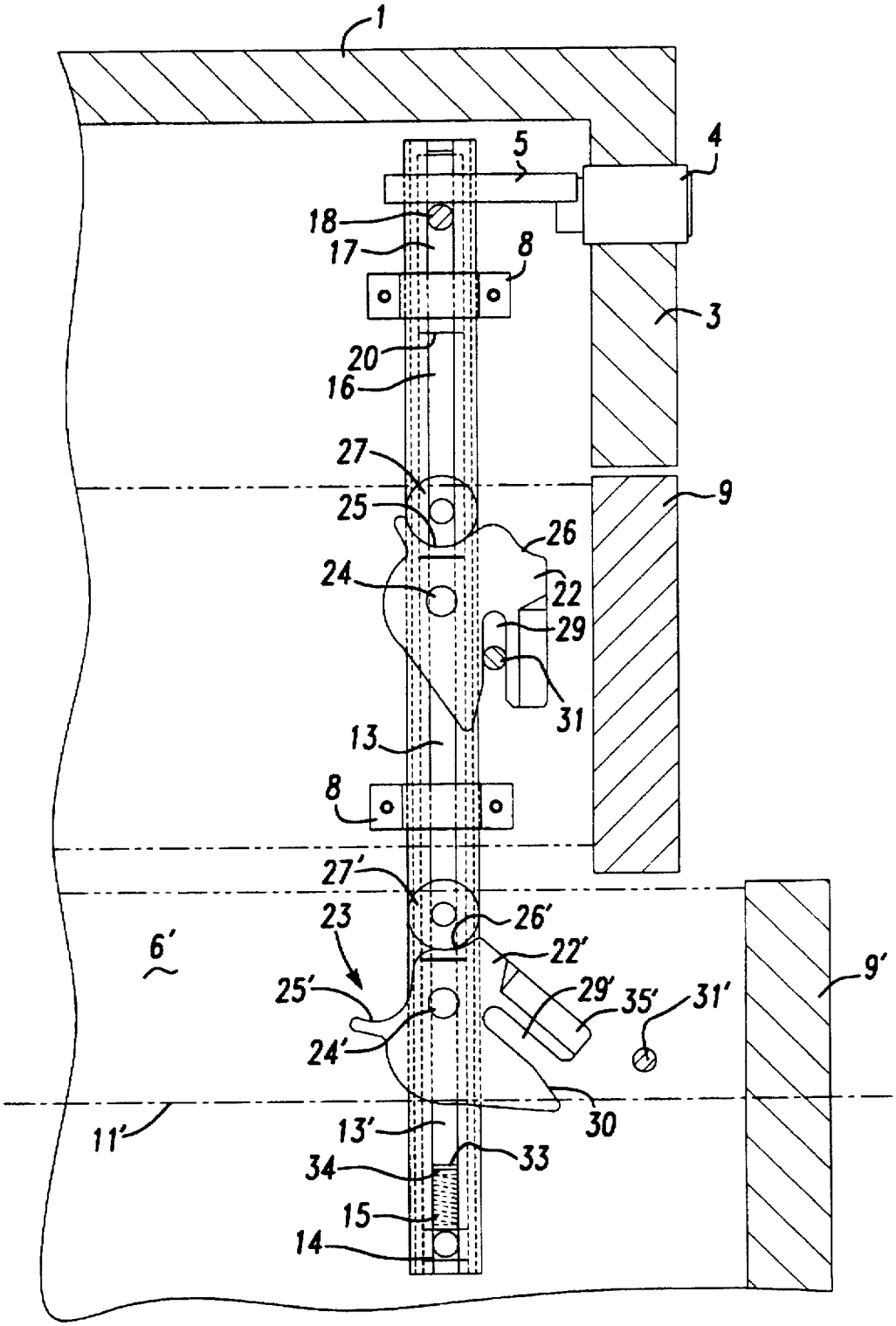
FIG. 2 is a view like FIG. 1, with the lowermost drawer being shown in an at least partially pulled-out position.

Two drawers 6, 6' movable in different sliding planes 11, 11' are associated with the body 1 as illustrated in FIGS. 1 and 2. Towards the ceiling, the body 1, as viewed from the front end, includes a panel 3 with an inserted lock 4. The lock 4 includes an eccentric journal 5 arranged eccentrically relative to the pivot axis of the lock 4.

The drawers 6, 6' have side walls 10, 10' and are each provided with a front panel 9, 9'. On the side wall 2 of the body 1, a guide 7 is arranged which rests on the inside and which is secured to the inner face of the side wall by means of fixing clips 8. The guide 7 defines a setting axis 12 which is positioned at right angles to the sliding planes 11, 11' of the drawers 6, 6'. The guide 7 is formed by a profile which has a C-shaped cross-section and which is provided with a slot which opens towards the side walls 10, 10' of the drawers. The drawer 6 is associated with a locking slide 13 which is adjustably guided in the guide 7.

The drawer 6', arranged underneath drawer 6, is associated with a locking slide 13'. The locking slide 13' is also adjustable in the guide 7 along the setting axis 12, as will be described below. Underneath the locking slide 13' an insertable plate 14 is arranged forming a fixed bearing which may be secured in the guide 7 by means of a bolt. For this purpose, the insertable plate 14 is inserted into the guide from underneath. The plate 14 has a projection which, in the upward direction, defines a stop face 33 extending parallel to the sliding plane 11'. In the free space formed between the inner face of the guide 7 covered by the insertable plate 14 and the projection of the insertable plate 14, a spring 15 is received and guided. The spring 15 is supported against the lower end face 34 of the locking slide 13' arranged thereabove.

Above the locking slide 13, a supporting element 16 is inserted into the guide 7. The supporting element 16 is also adjustable. The supporting element 16, via its end face 21, contacts the lower stop face 20 of a stop element 17. The stop element 17 is adjustable in the guide 7, via the eccentric journal 5. When displaced into the upper end portion, the stop element 17 is supported against the holding clip 19 of the guide 7.

At its upper end, the locking slide 13 associated with the drawer 6 carries a setting element 22. The setting element 22 has a setting contour 23 and is adjustable to a limited extent around the pivot axis 24. The setting contour 23 includes two engagement regions 25, 26 which constitute indentations, but are arranged at different distances from the pivot axis 24.

The setting contour 23 cooperates with a setting stop 27 which, with reference to the drawer 6, is arranged at the lower end of the supporting element 16. The setting stop 27 includes a roller which is fixed to the supporting element 16 and is rotatable around the bearing pin 28. To improve the embracing conditions of the setting stop roller 27, a lug 32 is arranged at the setting element 23 in the area of the first engagement region 25.

In the case of the pushed-in position of the drawers 6, 6' as illustrated in FIG. 1, a setting slot 29 in the setting element 22 extends parallel to the setting axis 12 of the guide 7 and of the locking slide 13, respectively. The setting slot 29 opens downwardly and, furthermore, includes a front stop face 30.

The setting element 22 has a guiding face 35 which, starting from the edge 36 facing the front panel 9, rises from the drawing plane to the control pin 31. The function of the guiding face 35 will be described in greater detail in connection with FIG. 2 for the lower drawer 6' whose setting element 22' is designed accordingly. In the pushed-in condition of the drawer 6, the setting slot 29 is engaged by a control pin 31 secured to the side wall 10 of the drawer 6 by a connecting plate.

At its lower end, the locking slide 13 carries a setting stop 27' in the form of a roller which is rotatably supported on the bearing pin 28' and which supports the setting element 22' of the locking slide 13' associated with the drawer 6'. With the illustrated pushed-in positions of the drawers 6, 6', the setting stop 27' is received in contact with the first engagement region 25' of the setting contour 23' of the setting element 22'. The setting element 22' is attached to the locking slide 13' to be pivotable to a limited extend around the pivot axis 24'. The setting contour 23' also includes a second engagement region 26' which is angularly offset with reference to the first engagement region 25'. The second engagement region 26' also constitutes an indentation. The first engagement region 25' also includes a supporting lug 32' to increase the contact area. The setting element 22' adjustable around the pivot axis 24' also includes a setting slot 29'. The setting slot 29' in the pushed-in condition of the drawer 6' extends parallel to the setting axis 12 and is engaged by a control pin 31' associated with the side wall 10' of the drawer 6'. The setting slot 29' is also provided with a stop face 30' whose function will be described in connection with FIG. 2. In FIG. 1, the lock 4 is in the open position. This means that the eccentric pin 5 has assumed its upper position close to the ceiling of the body 1. In consequence, the locking slides 13, 13' and the supporting element 16 are displaced upwardly by the force of the spring 15. The lower end face 34 of the locking slide 13' associated with the lowermost drawer 6' is thus arranged at a distance from the stop face 33 of the insertable plate 14.

In FIG. 2, the lowermost drawer is shown in a partially pulled-out position. For this purpose, the front panel 9' was acted upon in the sense of sliding the drawer 6' in its sliding plane 11 '. The control pin 31' acted on the setting element 22' which, as a result of the control pin 31' stopping against the boundary of the slot 29', is adjusted counter-clockwise around the pivot axis 24'. As a result of the increase in distance over the pivot angle covered by the setting element 22', the greater radial distance between the second engagement region 26' and the pivot axis 24', the locking slide 13' is adjusted downwardly, with its lower end face 34 coming to rest against the stop face 33 of the insertable plate 14. As the locking slide 13 and the supporting element 16 are supported against the fixed stop 20 of the stop element 17 held by the eccentric pin 5, the locking slide 13' can escape downwardly only to adjust against the stop 33. A further change in length of the column, consisting of the locking slides 13, 13' and the supporting element 16, cannot occur because the parts are now held and tensioned between the stops 20, 33, so that the drawer 6 cannot be opened.

The setting element 22 is secured against any pivot movement. The setting element 22 cannot effect the change in distance required for the locking slide 13 to pivot from the first engagement region 25 into the second engagement region 26. When pushing in the drawer 6', the control pin 31' comes into contact with the stop face 30', so that, as the pushing in process continues, a clockwise moment is applied to the setting element 22'. The engagement region 26' disengages relative to the setting stop 27. In view of the radial change in distance from the pivot axis 24' of the setting contour 23, when pivoting back into the starting position according to position 1, the spring 15, which acts on the locking slide 13', is adjusted upwardly towards the starting position. If, accidentally, when the drawer 6' is in the pulled-out position, the setting element 22', as a result of a different direct action, is pivoted into a position according to FIG. 1, wherein the slot 29' extends vertically, the drawer 6' can nevertheless be closed. When moving the drawer in the closing direction, the control pin 31' stops against the guiding face 35' and bends said portion elastically into the drawing plane which enables the control pin 31' to pass the guiding face 35' and return into the slot 29'. The deflected portion then springs back.

Figure 3:
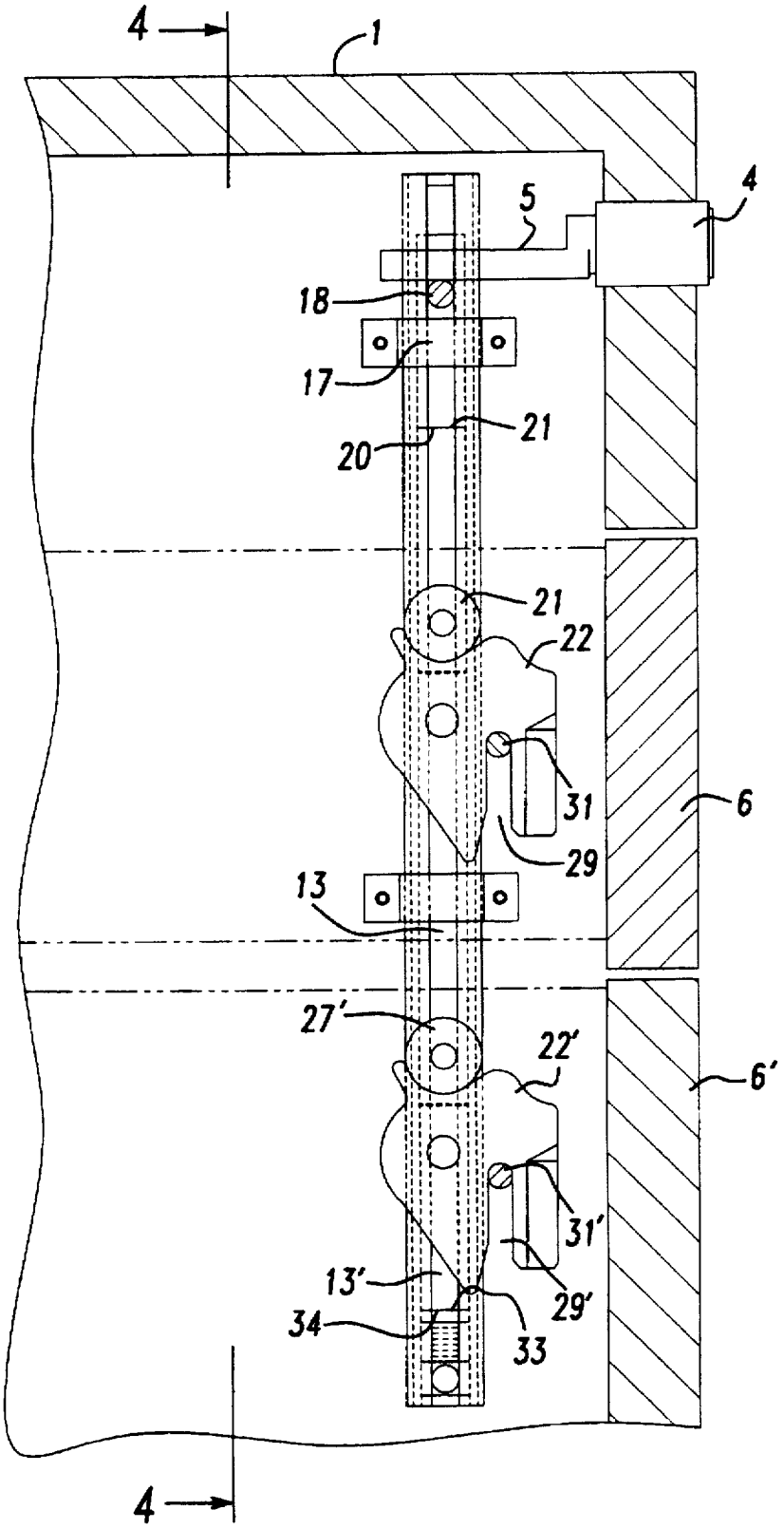
FIG. 3 is a view like FIG. 1 with the drawers pushed into the body and centrally locked.
Figure 4:
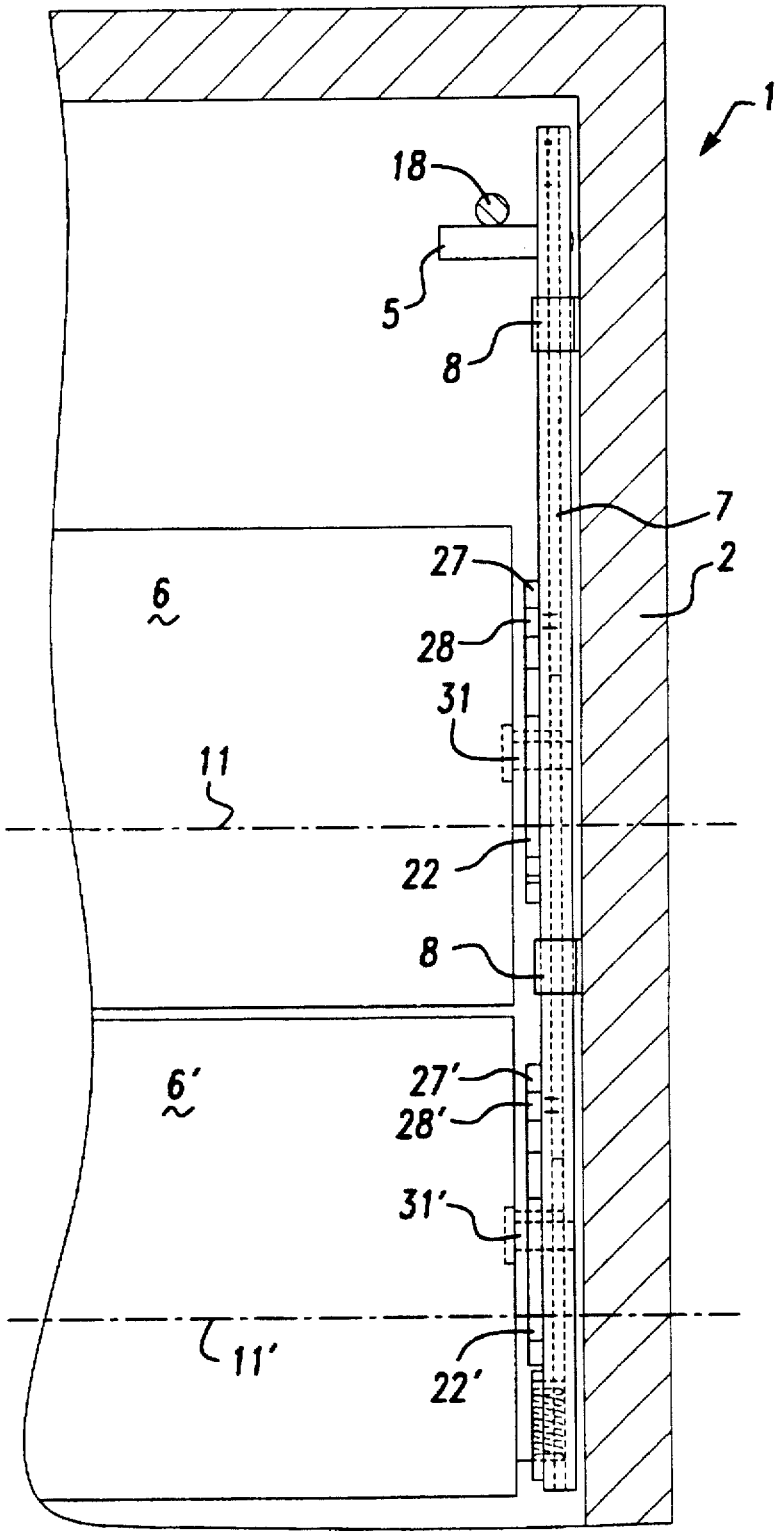
FIG. 4 is a section view of FIG. 3 along line IV—IV thereof.

FIGS. 3 and 4 show the central locking position, where the lock 4 is operated such that the eccentric pin has moved away from the inner face of the ceiling of the body 1. Thus the drawers 6, 6' are in the pushed-in position. The first stop element 17, the supporting element 16 and the locking slides 13, 13' arranged thereunder, are displaced downwardly into a position, so that the control pins 31, 31' of the two drawers 6, 6' enter the associated setting slot 29, 29' more deeply. Furthermore, in the process, the stop element 17, the supporting element 16 and the locking slides 13, 13' are displaced downwardly to such an extent that the lower end face 34 of the locking slide 13' has come to rest against the stop face 33 of the insertable plate 14. As the length of the column clamped in between the stops 20, 33 cannot change, none of the drawers 6, 6' can be pulled out of the body 1.

While the above detailed description describes the preferred embodiment of the present invention, the invention is susceptible to modification, variation and alteration without deviating from the scope and fair meaning of the subjoined claims.

I claim:

1. A drawer locking apparatus used with at least two drawers arranged one above the other in a body of a piece of furniture including a front panel, two side walls, a rear wall and, a base, the combination comprising:

locking slides on one side wall of the body, said locking slides transversely positioned with respect to sliding planes of the drawers, said locking slides are linearly adjustable along a setting axis in a guide, said guide having a front side and back side, said front side facing the front panel;

setting elements associated with said locking slides, said setting elements are fixed to the associated locking slide so as to be pivotable to a limited extent between an open position and a locking position around a pivot axis extending perpendicularly to the setting axis, said setting elements each including a setting slot extending parallel to the setting axis and said slots positioned between the drawer front panel and the front side of the guide in a pushed-in condition of the drawers;

a setting contour on each said setting element is in contact with setting stops of the adjoining locking slide, said setting contours include a first engagement region for holding the setting elements in the pushed-in position of the drawers and a second engagement region for holding the setting element of the operated drawer in a pivoted locking position to an open position of the operated drawer;

a control pin for actuating said setting elements, arranged at each of the side walls of the drawers positioned opposite the one side wall of the body, said control pin, when operating one of the drawers, is loadable for the purpose of adjusting a setting element;

stops for limiting the adjustment path of the locking slides, said locking slides are jointly loaded by a spring so as to be in contact with one of the stops; and said control pin carried by each drawer, said control pins, in the pushed-in condition of the drawers, engage the setting slots of the setting elements, said locking slides of the drawers adjoining the locking slide of the operated drawer in the direction of the spring being displaced against a stop.

2. The drawer locking apparatus according to claim 1, wherein the setting stops are each arranged at the lower end of each locking slide and said setting elements are each arranged at the upper end of each locking slide.

3. The drawer locking apparatus according to claim 1, wherein the setting stops are rollers.

4. The drawer locking apparatus according to claim 1, wherein the locking slides are loaded by the spring in an upward direction against a first stop arranged above the locking slides.

5. The drawer locking apparatus according to claim 1, wherein a first stop is adjustable along the setting axis against the spring.

6. The drawer locking apparatus according to claim 5, wherein a lock is provided for adjustment purposes, which serves for centrally locking or releasing all drawers.

7. The drawer locking apparatus according to claim 1, wherein a second stop is formed by the spring adjusted to form a block and supported against a fixed bearing or by a face of the fixed bearing.

8. The drawer locking apparatus according to claim 1, wherein a supporting lug is associated with the first engagement region.

9. The drawer locking apparatus according to claim 1, wherein the guide receiving the locking slides is linearly adjustable to a limited extent.

10. The drawer locking apparatus according to claim 9, wherein a lock is provided for adjustment purposes, which serves for centrally locking or releasing all drawers.

* * * * *